US008118980B2

(12) United States Patent
Mark

(10) Patent No.: US 8,118,980 B2
(45) Date of Patent: Feb. 21, 2012

(54) LOADING DEVICE FOR A SHOE PRESS ROLL

(75) Inventor: Wolfgang Mark, Meerbusch (DE)

(73) Assignees: Gapcon GmbH (DE); Gebr. Bellmar GmbH Maschinenfabrik (DE)

( * ) Notice: Subject to any disclaimer, the term of this patent is extended or adjusted under 35 U.S.C. 154(b) by 29 days.

(21) Appl. No.: 12/525,187

(22) PCT Filed: Jan. 29, 2008

(86) PCT No.: PCT/EP2008/051062

§ 371 (c)(1),
(2), (4) Date: Jul. 30, 2009

(87) PCT Pub. No.: WO2008/092868

PCT Pub. Date: Aug. 7, 2008

(65) Prior Publication Data

US 2010/0096098 A1 Apr. 22, 2010

(30) Foreign Application Priority Data

Jan. 30, 2007 (DE) ..... 10 2007 004 607

(51) Int. Cl.
*D21F 1/00* (2006.01)

(52) U.S. Cl. ..... 162/210; 162/358.3; 162/361

(58) Field of Classification Search ..... 162/210, 162/358.3, 361
See application file for complete search history.

(56) References Cited

U.S. PATENT DOCUMENTS

2001/0013400 A1 8/2001 Jorma
2001/0015269 A1 8/2001 Brox

FOREIGN PATENT DOCUMENTS

DE 195 15 832 C1 5/1996
EP 0 933 471 A2 8/1999

*Primary Examiner* — Mark Halpern
(74) *Attorney, Agent, or Firm* — Factor Intellectual Property Law Group, Ltd.

(57) ABSTRACT

The present invention relates to a loading device for a shoe press having a shoe press roll (1) and a mating roll (2) for forming a press nip, preferably in a dewatering device such as in a papermaking machine, through which press nip at least one paper web is guided for dewatering. The shoe press roll (1) has at least one press shoe (4) and at least one supporting device (5), and the press shoe (4) and the supporting device (5) are connected by a multiplicity of hydraulic devices, in order to load the press shoe (4). The invention is characterized in that the hydraulic device has at least one first guide element (7) for guiding a cylinder sleeve (8) substantially linearly, and the cylinder sleeve (8) engages at least in sections into at least one second guide element (9) which is connected to the press shoe (4) in a substantially stationary manner.

22 Claims, 5 Drawing Sheets

LOADING DEVICE FOR A SHOE PRESS ROLL

This application is a 371 of PCT/EP08/51062 filed 29 Jan. 2008.

The present invention relates to a loading device for a shoe press, preferably for use in a dewatering device, particularly in a papermaking machine, and to the use of such a loading device in making paper, paperboard and/or cardboard.

Loading devices for shoe presses are known from prior art.

Thus, shoe press devices known from prior art are used, for example, for the mechanical dewatering of moist fiber webs to increase particularly the dry content of the fiber web before thermal drying with, for example, drying cylinders. In addition to using shoe press devices paired rolls are used in prior art for this purpose between which a paper web is likewise mechanically dewatered, dewatering being restricted substantially over a linear contact portion between the two rolls.

As known from prior art, however, dewatering performance of the press device is mainly a function of the so-called press impulse resulting as a product of the force and time involved in pressing. Since the time is in turn a function of the web speed the press impulse is higher the longer the nip, resulting in a consistent improvement in the dewatering performance.

Further developments in press technology resulted in use of shoe press devices which as compared to use of paired rolls propose use of a press shoe in combination with a mating roll so as not to limit dewatering to a substantially linear press nip, but instead to make dewatering available over a defined surface area.

Shoe press devices usually feature a press shoe urged against a roll preferably by means of a hydraulic force application unit, the press shoe preferably being covered by a jacket in direct or indirect contact with the fiber web. In production operation involving, for example, dewatering a fiber web the jacket is guided over the press shoe and is located on the press shoe so as to minimize wear.

Since the press shoe extends over the full width of the paper web of a papermaking machine, usually a multiplicity of force application sections are provided to permit substantially open and closed loop control of the nip force between the press shoe and the mating roll over the width of the papermaking machine. The force application units involved are hydraulic pistons mounted on a carrier and which communicate the nip force to the press shoe. To enhance the flexibility in application of the nip force, particularly also over the width of the papermaking machine, multi-section press shoes are used which also makes it possible to apply differing nip forces between the various segments of the width of the paper web. It is also the intention here to avoid disruptions in the pressure profile, particularly in the transverse direction of the machine damaging to the quality and processing availability of the web being dewatered, such as, for example, a paper web.

The loading unit itself mostly includes in accordance with prior art hydraulic pistons accommodated in cylindrical recesses of the carrier and disposed axially shiftable. However, since in operation the location of the press shoe may alter e.g. due to changes in length or load in relation to the carrier caused by heat, it is necessary that the hydraulic piston is biased for example against the press shoe such that even under unfavorable operating conditions it is retracted from the underside of the press shoe or maintained in contact therewith. The reason for this is that, for example, should the hydraulic piston become tilted the hydraulic pressure between the press shoe and the hydraulic piston is reduced. Under worst case conditions this can result in the hydraulic cylinder losing contact with the underside of the press shoe because of the drop in hydraulic pressure.

To solve this problem it is proposed in prior art to employ a coil spring, for example, which biases the hydraulic cylinder to substantially prevent the hydraulic cylinder from being persistently separated from the underside of the press shoe.

However, the problems involved with this solution is that the hydraulic cylinders need to be already biased on assembly thus complicating assembly. Apart from this, it may happen that the spring becomes fatigued in time with operation of the press device.

The object of the invention is to provide a shoe press device in which the drawbacks known from prior art are eliminated, at least in part, whilst simplifying the structure and assembly of the loading unit, resulting also in a reduction in the corresponding costs of such a loading device.

The object of the present invention is achieved by a loading device as it reads from claim 1. Preferred example embodiments of the loading device are the subject matter of the sub-claims.

The loading device in accordance with the invention for a shoe press comprises at least one shoe press roll and a mating roll for forming a press nip, the shoe press being used particularly in a dewatering device, particularly in a papermaking machine, for dewatering at least one web of paper or fiber or the like.

A web of paper or fiber is especially a mix of solid and liquid components which, for example, in the production of paper, cardboard or paperboard comprises preferably fibers, fillers and chemical additives or, on the other hand, water as the dilutent.

The shoe press comprises at least one press shoe and at least one supporting device, press shoe and supporting device being connected preferably by a multiplicity of hydraulic devices serving to load the press shoe particularly against the mating roll. The loading device is characterized in that the hydraulic device comprises at least one first guide element serving substantially to linearly guide a cylinder sleeve as a component of the hydraulic device and is characterized in that the cylinder sleeve engages at least sectionwise at least one second guide element. Furthermore the second guide element is preferably connected substantially fixedly to the press shoe.

The press nip in accordance with the present invention is understood to be the contact portion between the press shoe and the mating roll, the press shoe being covered by a jacket and the paper web being guided directly or also with the use of felts or carrying devices such as, for example, belts through the press nip. The press nip is furthermore characterized in that it can be loaded particularly also over the width of the papermaking machine with different pressures and extended in the running direction of the machine over a predefined circumferential path, among other things, about the mating roll, resulting in the circumferential path being formed by the shape and configuration of the press shoe which as a function of its shape and location in relation to a mating roll provides a predefined pressure profile for dewatering the paper web.

A supporting device in accordance with the present invention is understood to be a device of the shoe press roll structured preferably substantially resistant to bowing. Such a supporting device may be for instance a roll yoke on which particularly the hydraulic devices are arranged predefinedly spaced over the length of the roll yoke in thus providing the connection between the supporting device and the press shoe or sections of the latter.

The hydraulic device comprises in accordance with the present invention two guide elements and at least one cylinder sleeve, whereby it is to be noted that the proposed geometric shapes can illustrate the mathematical shape only roughly approximated and that the actual shapes in which the individual elements are configured can and will be adapted in shape and function between the individual components.

In accordance with one preferred embodiment of the present invention there is provided in the engaging portion between the cylinder sleeve and the second guide element, i.e. the guide element connected substantially fixedly to the press shoe, at least one fluid connection interconnecting a first and second fluid portion of the hydraulic device. A connection in this sense is understood to be a space achieving an exchange of a fluid in the sense of a fluid connection, a fluid in this case being understood to be, among other things, hydraulic fluids and the like as are known in prior art.

A first fluid portion is understood to be particularly a space within the hydraulic device formed substantially by a section of the first guide element, at least one inner section of the cylinder sleeve and at least one section of the second guide element. Such a fluid portion is connected in accordance with the present invention to a feeder for at least one corresponding fluid and at least one fluid connection is provided connecting this first fluid portion to the second fluid portion for the exchange of the fluid.

In this arrangement the second fluid portion is formed by at least one section of the cylinder sleeve, at least one section of the second guide element and at least one section of the press shoe, it being understood that a corresponding hydraulic pressure, input for example via a feeder into the first fluid portion, can be communicated via the connection to the second fluid portion at the underside of the press shoe.

The fluid connection between the first and second fluid portion is in accordance with a particularly preferred embodiment, for example, a slot, a groove, a drilling, a recess, combinations thereof or the like, the nature of the selected connection providing an adequate exchange of fluid between the two portions. In particularly, a multiplicity of fluid connections may also be provided.

In accordance with the present invention the first guide element is configured such that it substantially corresponds to the inner diameter of the cylinder sleeve and configured for example as a truncated cylinder. In this arrangement it is to be taken into account that a guide element configured as such comprises, in particular, at least one seal adequately sealing at least the inner circumference of the cylinder sleeve whilst simultaneously permitting axial motion of the cylinder sleeve and to a certain extent also vertically e.g. for tilting action. In this arrangement the first guide element may comprise in particular a contact portion, involving in the loading device of the cylinder only a certain portion coming into contact with the inner surface of the cylinder sleeve in thus providing corresponding freedom of movement of the cylinder sleeve.

In accordance with a further, particularly preferred embodiment the first guide element is a recess in the supporting device configured in particular as a so-called blind hole. In this arrangement the blind hole is shaped such that the cylinder sleeve is accommodated at least sectionwise therein. To adequately seal the first fluid portion from the ambience there is provided in accordance with a further preferred embodiment a seal at the outer circumference of the cylinder sleeve accommodated particularly also in a bulge to ensure a predefined tilting motion of the cylinder sleeve in the blind hole. Furthermore, the cylinder sleeve preferably comprises in the region of the lower face an outer circumferential chamfer ensuring in particularly an improved freedom of movement of the cylinder sleeve in practically preventing damage to the inner surfaces of the blind hole.

In accordance with an another preferred embodiment of the present invention the first guide element is configured multipart, particularly the truncated cylinder being connected by a circumferential flange to the supporting device and the truncated cylinder being shiftingly arranged within the cylinder sleeve. In addition the truncated cylinder comprises a further, preferably centered, drilling within which a locating cylinder is arranged longitudinally shiftable.

Such a locating cylinder may preferably comprise a stepped circumferential cross-section, it comprising at least one, preferably a multiplicity of the circumferential seals arranged in particular on the differing steps of the outer circumferential cross-sections. The locating cylinder comprises in accordance with a further particularly preferred embodiment a longitudinal connection to the second guide element in serving, for example, to safeguard the hydraulic system against the cylinder sleeve from dropping out of place or from being pulled out of the first guide element.

In accordance with yet a further preferred embodiment of the present invention the stepped locating cylinder is also employed as a cylinder for retracting the press shoe, the interspace between the truncated cylinder and the locating cylinder serving as a separate hydraulic device with which the press shoe can be unloaded or lifted from the mating roll via the longitudinal connection and the second guide element.

In accordance with still another particularly preferred embodiment the second guide element is a disk arranged at the press shoe and comprising at least one radial circumferential groove which is engaged by the cylinder sleeve comprising, for example, a corresponding offset or face. In this arrangement the offset or face is configured such that, as viewed from the circumference of the cylinder sleeve, it extends inwardly or outwardly, particularly at least one predefined section of the face of the cylinder sleeve remaining open so that the fluid comes into direct contact with the surface of the press shoe.

The second guide element is configured in accordance with a further preferred embodiment of the present invention as a stepped ring forming an inwardly facing groove together with the underside of the press shoe engaged, for example, by a circumferential flange in the sense of an offset or face of the cylinder sleeve. This thus makes available an outwardly oriented guide also making freedom of movement possible transversely in keeping with the embodiment as described previously. Furthermore, the circumferential flange makes it possible to arrange seals and guiding surfaces at the surface facing the underside of the press shoe.

In accordance with a further particularly preferred embodiment the offset or face of the cylinder sleeve, oriented substantially parallel to the underside of the press shoe in normal operation, comprises at least one section forming a sealing surface with the press shoe.

In addition to a corresponding sealing surface this section of the offset or face of the cylinder sleeve may also feature guiding surfaces or guide rings assisting orientation of the cylinder sleeves in relation to the underside of the press shoe. It may furthermore be provided for that particularly the outer circumference of the face of the cylinder sleeve comprises, for example, a chamfer or rounding to best prevent the underside of the shoe from becoming marked by the cylinder sleeve in operation.

In accordance with yet another particularly preferred embodiment of the present invention the supporting device of the seal at the face of the cylinder sleeve is smaller than, or substantially equal to, the diameter of the cylinder sleeve, particularly smaller than, or substantially equal to, the inner diameter of the cylinder sleeve. The particular advantage of this is that in operation the cylinder sleeve is urged preferably against the underside of the press shoe since the force per surface unit in the cylinder sleeve in the direction of the underside of the shoe is greater than, or equal to, the counterforce per surface unit forcing the cylinder sleeve away from the press shoe.

In accordance with a further particularly preferred embodiment the face section or offset of the cylinder sleeve engages the engaging portion of the second guide element in such a way that the latter is guided with a predefined clearance with the radial circumferential groove of the second guide element. In this arrangement the clearance may be selected such that it is smaller than the maximally functionable sealing spacing of the sealing surfaces or seal between the section of the face of the cylinder sleeve and the press shoe to thus ensure that the hydraulic pressure in the second fluid portion is also substantially maintained even under unfavorable operating conditions.

In accordance with yet a further particularly preferred embodiment of the present invention the first guide element is connected to the supporting device positively, non-positively or material positively, such a connection being, for example, a bolted connection in which the first guide element is oriented such that it simplifies an inflow of the fluid via a hydraulic feeder.

In accordance with still another particularly preferred embodiment of the present invention the cylinder sleeve is movable substantially axially in relation to the first guide element and is preferably arranged tiltable about a predefined angle $\alpha$ in relation to the main axis of the first guide element. Such tiltability is basically an advantage to permit compensating particularly displacements of the press shoe in operation. Furthermore, the second guide element is configured in relation to the faces or offsets of the cylinder sleeve so that the press shoe can be shifted vertically.

In accordance with still a further particularly preferred embodiment there is provided between the first guide element and the cylinder sleeve at least one seal such as for example a ring seal, an O-seal, or the like.

In accordance with yet a further particularly preferred embodiment the second guide element is connected positively, non-positively and/or material positively to at least one section of the press shoe, bolting representing one possible form for this fastening.

In accordance with the present invention the cylinder sleeve is arranged substantially floating in relation to the press shoe and the hydraulic device, i.e. the cylinder sleeve being movable both longitudinally and transversely to a predefined degree to particularly communicate the hydraulic pressure built up in the hydraulic element during operation to the underside of the press shoe.

In accordance with still another particularly preferred embodiment the fluid connection between the first and second fluid portion is made available in that the overlapping surfaces between the second guide element and the face or offset of the cylinder sleeve are configured such that a continuous fluid connection is made available between the two fluid portions. This may be achieved, for example, by the corresponding opposing surfaces of the face of the cylinder sleeve and of the disk of the second guide element feature a predefined structure forming a fluid connection by, for example, the overlap of the corresponding structures. In this arrangement the structure of the surface may take the form of, for example, a groove, ribbing, gritted, a multiplicity of spacers, a predefined roughening of the surfaces, combinations thereof, or the like. It may also be, of course, sufficient to structure just a single surface as such to provide the fluid connection.

In accordance with yet a further particularly preferred embodiment particularly the cylinder sleeve and/or the guiding device or at least parts of the loading device are made of at least a material selected from a group comprising, for example, steel, bronze, brass, stainless steel, composites, combinations thereof, and the like.

The present invention also involves use of a loading device, as described above, in a paper, paperboard and/or cardboard machine for loading at least one dewatering device such as, for example, a shoe press roll or a press shoe in a shoe press roll or a corresponding dewatering device such as, for example, a dewatering foil or a dewatering bar. The present invention involves furthermore use of a loading device for the production of paper, paperboard and/or cardboard.

The present invention will now be detailed by way of preferred example aspects, it being expressly understood that the present invention is not restricted to such embodiments, it being in keeping with the present invention that the corresponding embodiments can be modified or adapted in also being covered by the scope of protection afforded by the present invention.

Figure 1:
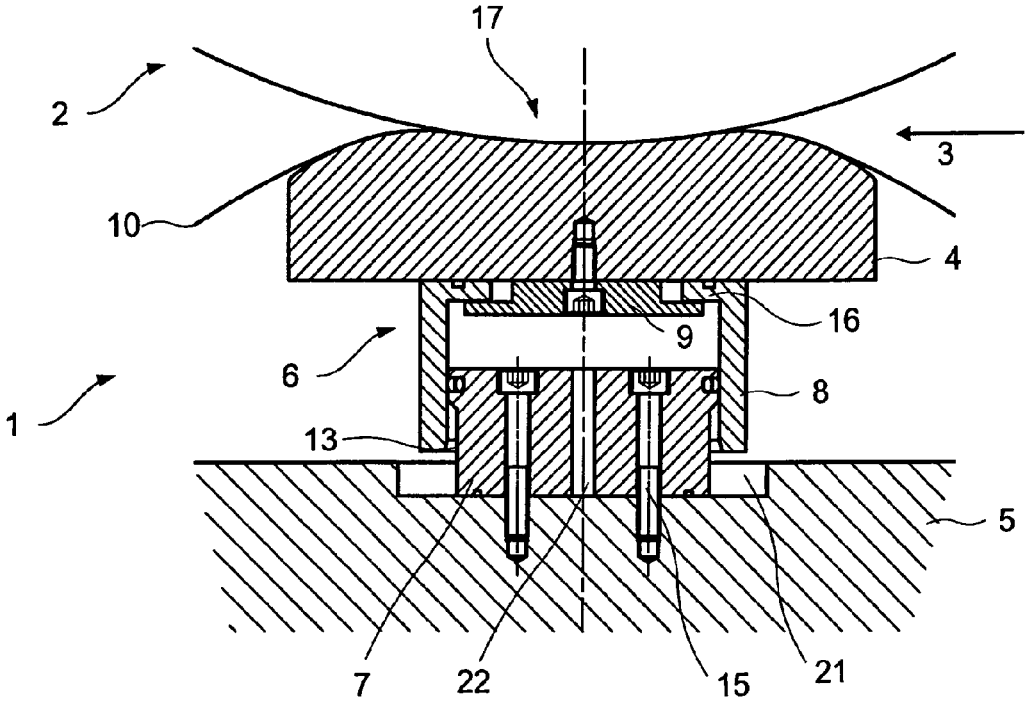
FIG. 1 is a side view in section of a loading device for a shoe press in accordance with the present invention.

Referring now to FIG. 1 there is illustrated a diagrammatic side view of the loading device in accordance with the invention for a shoe press in which the shoe roll 1 can be pressed against a mating roll 2, the contact portion 17 being formed by the press shoe 4 with the press jacket 10 and the mating roll 2.

For dewatering a web of paper, for example, it can be guided through the press nip, the web being dewatered in operation along the contact portion 17 between the press shoe 4 with the press jacket 10 and the mating roll 2. In this arrangement it will be appreciated from the configuration that the press shoe 4 is arranged substantially fixedly and that the mating roll 2 in its rotation entrains the press jacket 10.

In accordance with the present embodiment the profile of the press shoe 4 is configured substantially as the circumferential section of the mating roll. It is to be noted that a deviation from this structure is possible, depending on the wanted pressure profile within the contact portion 17. The press shoe 4 is connected via the hydraulic device 6 to the supporting device 5 which in the embodiment as illustrated in this case features a recess 21 within which the first guide element 7 is secured by means of bolts 15.

Figure 5:
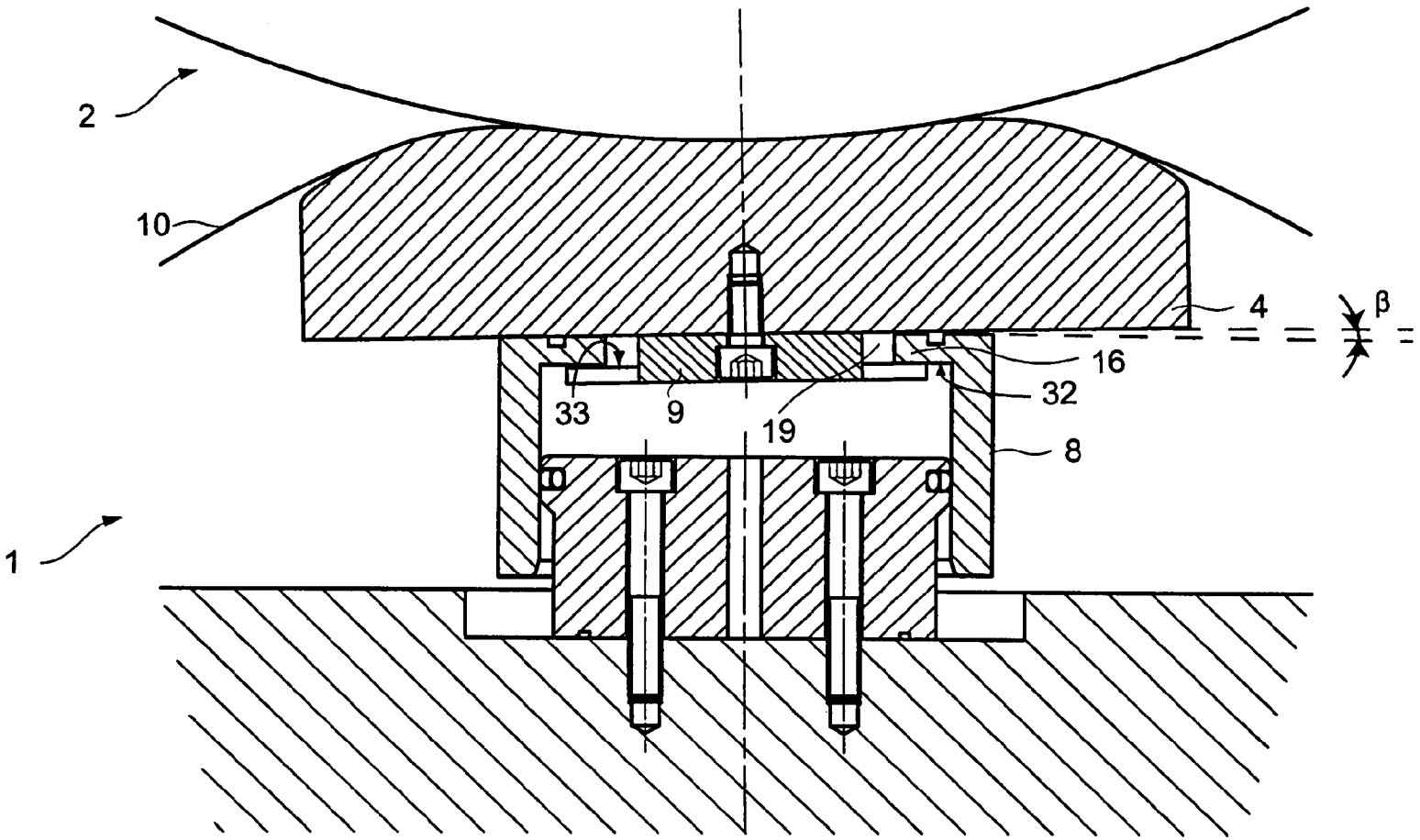
FIG. 5 is a side view in section of the loading device as shown in FIG. 2 showing the press shoe tilted otherwise in operation.

Arranged at the first guide element 7 is a cylinder sleeve 8 which in relation to the underside of the press shoe 4 comprises a face 16 engaging the second guide element 9 and the circumferential groove 19 arranged therein (see FIG. 5). The face 16 of the cylinder sleeve 8 comprises a seal 18 facing the underside of the press shoe 4 in sealing the second fluid portion 12 from the ambience.

In this arrangement the second fluid portion 12 is formed particularly by at least one part of the surface of the cylinder sleeve 8 with the face 16, part of the second guide element 9 and part of the underside of the press shoe 4.

The circumferential groove 19 of the second guide element 9 is selected in size so that the clearance between the face 16, the cylinder sleeve 8 and the circumferential groove 19 between the second guide element 9 and the underside of the press shoe 4 to ensure, on the one hand, an adequate seal for the fluid existing in the second fluid portion 12 and, on the other, adequate freedom of movement.

The objective of this is to guide the hydraulic fluid fed by the feeder 22 into the first fluid portion 11 via a fluid connection 14 into the second fluid portion 12 to thus effect a corresponding pressure loading of the press shoe 4. In this arrangement the hydraulic device 6 is supported by the supporting device 5 in urging the cylinder sleeve 8 together with the press shoe 4 in the direction of the mating roll 2.

Figure 2:
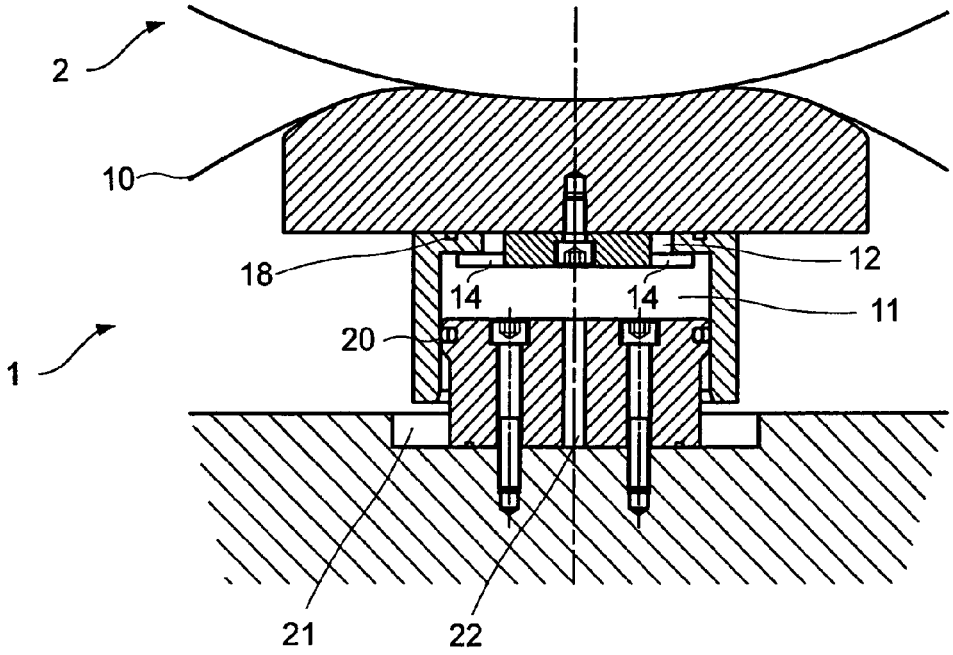
FIG. 2 is a side view in section of another loading device of the present invention.

Not shown in FIG. 1 is how the hydraulic fluid is fed to the feeder 22 and the fluid connections between the first fluid portion 11 and the second fluid portion 12, FIG. 2 illustrating the arrangement of the fluid connection.

Referring now to FIG. 2 there is illustrated a further embodiment of a loading device in accordance with the invention in a side view in section illustrating in addition to the fluid portions 11 and 12 also two grooves 14 forming the fluid connection between the fluid portions 11 and 12.

Figure 3:
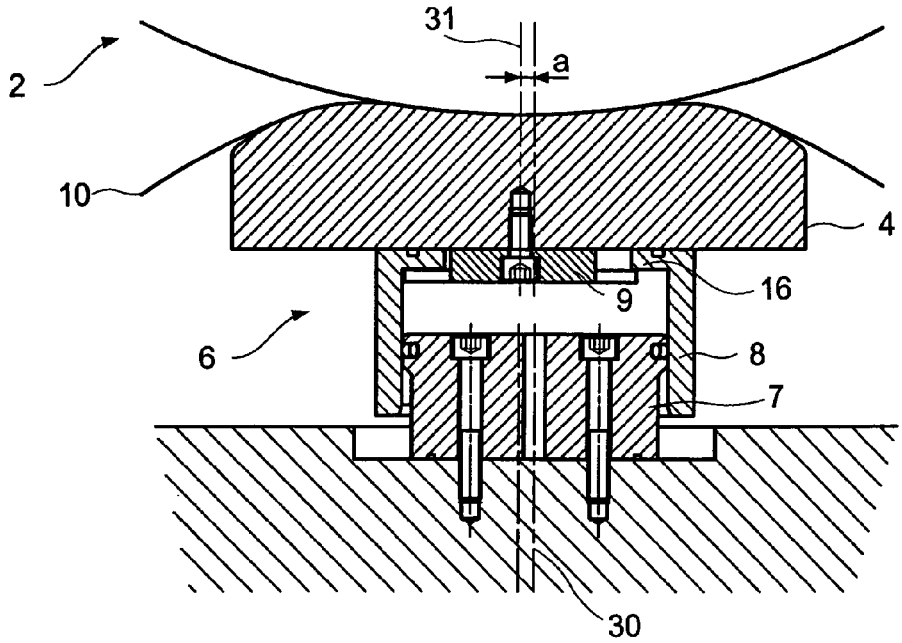
FIG. 3 is a side view in section of the loading device as shown in FIG. 2 in which the press shoe is displaced vertically in relation to the first guiding device.

Referring now to FIG. 3 there is illustrated a further aspect of the loading device in accordance with the invention as shown in FIG. 2 in which, however, the press shoe 4 is arranged vertically about the spacing a staggered from the axis 30 of the first guiding device 7. Such operating conditions may occur, for example, due to a change in length or temperature fluctuations or due to irregularities in the production process, FIG. 3 illustrating to what extent the loading device in accordance with the invention can compensate deviations from the zero position (the overlap or deviation thereof in the two axes 30, 31). This Fig. also makes it clear how the face 16 of the cylinder sleeve 8 engages correspondingly lower in the circumferential groove 19 of the second guide element 9 in thus making available a vertical clearance for movement of the press shoe 4. In this arrangement the maximum travel is designed to ensure that the face portion 16 of the cylinder sleeve 8 does not emerge from the groove 19 itself in thus practically preventing tilting of the loading device. In addition, this device is designed so that even in an extreme deviation of the press shoe 4 in relation to the first guiding device 7 an adequate seal of the fluid portions 11 and 12 is assured in thus providing sealing contact of the face 16 on the underside of the press shoe 4.

Figure 4:
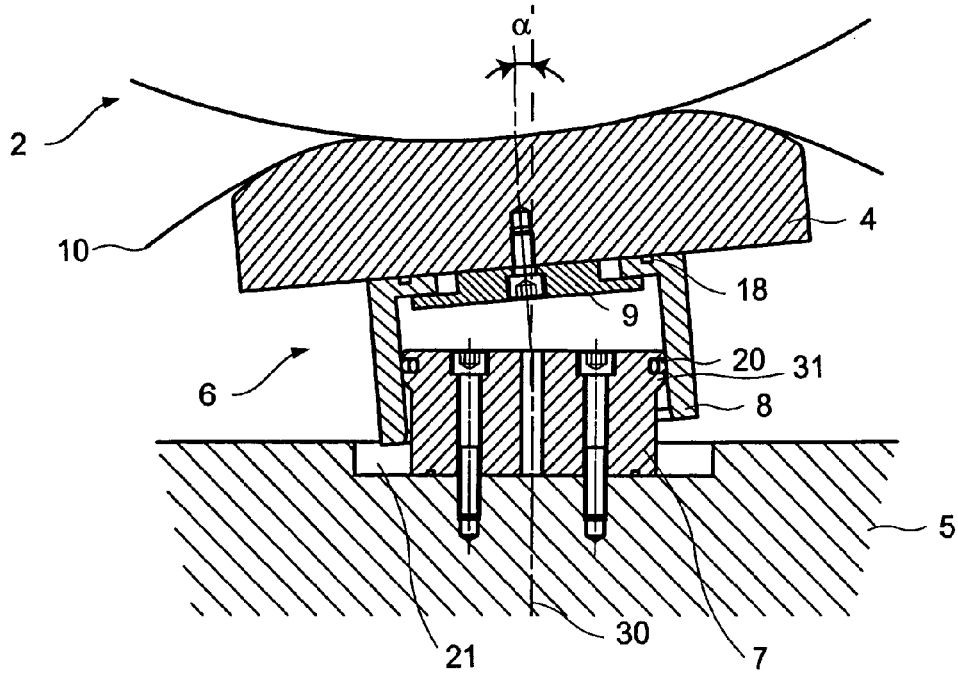
FIG. 4 is a side view in section of the loading device as shown in FIG. 1 showing the press shoe tilted in operation.

Referring now to FIG. 4 there is illustrated a further aspect of the loading device in accordance with the invention as shown in FIG. 1 in the zero position, whereby in this case the press shoe 4 is tilted about a predefined angle $\alpha$. This situation too, may occur due to unexpected changes in operation, making it clear that the device is able to compensate any tilting or rotary motion of the press shoe by a corresponding angular offset of the first and second guide elements 7, 9. In this arrangement the present embodiment now makes it possible to tilt the cylinder sleeve 8 substantially about the portion of the seal 20, a seal 20 being incorporated in a circumferential bulge 31 for this purpose, permitting added freedom of movement so that the cylinder sleeve 8 can be tilted about the portion of the seal 20 without causing an unwanted leakage of the fluid. In addition, the recess 21 of the supporting device 5 provides the necessary freedom of movement so that the cylinder sleeve 8 in the predefined operating position does not come into contact with the supporting device 5. In this position of the loading device 6 too, it is assured that the hydraulic pressure in the first and second fluid portion 11, 12 remains substantially the same so that a corresponding contact pressure can be communicated to the press shoe.

Referring now to FIG. 5 there is illustrated a further diagrammatic aspect of the loading device in accordance with the invention as shown in FIG. 2, except that in this case it is not the complete hydraulic device 1 that is tilted directly but merely the press shoe 4 with the second guide element 9 in relation to the cylinder sleeve 8. In this arrangement the corresponding freedom of movement results from the clearance of the circumferential groove 19 of the second guide element 9 with the face of the cylinder sleeve 8. In the case as shown in FIG. 5 the press shoe can be tilted about an angle $\alpha$, the corresponding clearance in the circumferential groove 19 being designed so that the fluid is maintained adequately sealed between the face 16 of the cylinder sleeve 8 and the underside of the press shoe 4 at a maximum tilt angle $\beta$.

Although FIGS. 3 to 5 show the various positions and possible deviations of the press shoe 4 singly, it is, of course, understood that it is also in keeping with the present invention that the device in accordance with the invention can also compensate any combination of these shifts, tilts and movements simultaneously in thus providing a device which now makes it possible to ensure adequate stability of the press shoe 4 in relation to the mating roll 2 even under difficult or unexpected operating conditions.

Figure 6:
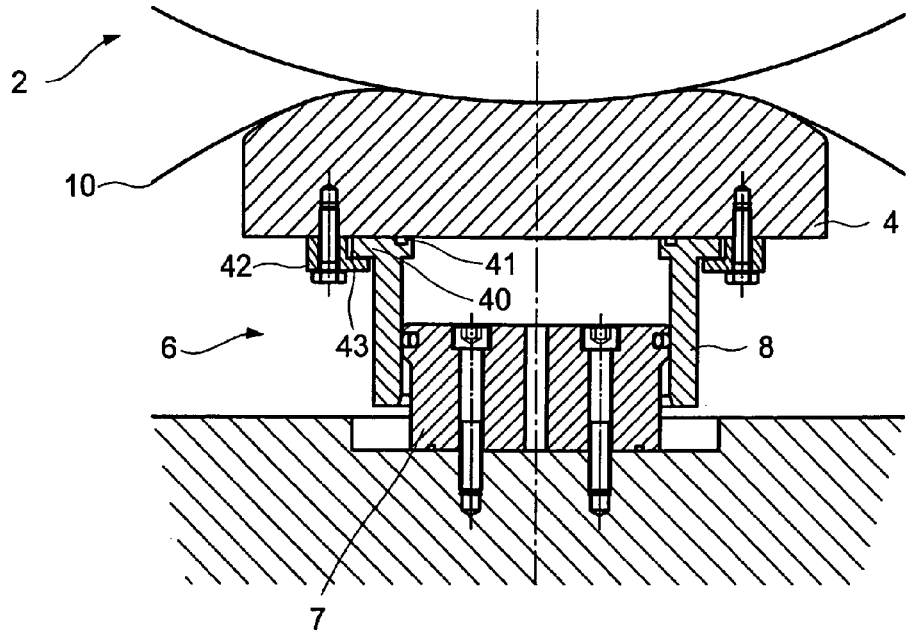
FIG. 6 is a side view in section of the loading device feature an alternative embodiment of the second guiding device.

Referring now to FIG. 6 there is illustrated yet another preferred embodiment of the present invention in which the cylinder sleeve 8 comprises at the top circumference a flange 40 protruding inwardly and outwardly. Arranged in this flange is, among other things, a sealing ring 41 forming together with the underside of the press shoe the surface for sealing off the hydraulic fluid from the ambience. As evident from the embodiment shown in FIG. 6 the flange is accommodated in the outer portion in a groove 43 of a stepped ring 42, the latter being fixedly connected to the underside of the press shoe 4 in forming together therewith the groove 43. In this arrangement the groove is configured such that the flange 40 is arranged vertically shiftable to make for the freedom of movement for the press shoe 4 in relation to the hydraulic device 6 the same as in the example aspect as described previously. Furthermore, it is also possible by selecting a corresponding clearance of the flange 40 in the groove 43 to endow the cylinder sleeve 8 with a certain tiltability making for further freedom of movement.

The stepped ring 42 in the embodiment as shown is secured to the underside of the press shoe 4 by being bolted thereto, it being, of course, also in keeping with the present invention to use alternative fastening means.

Figure 7:
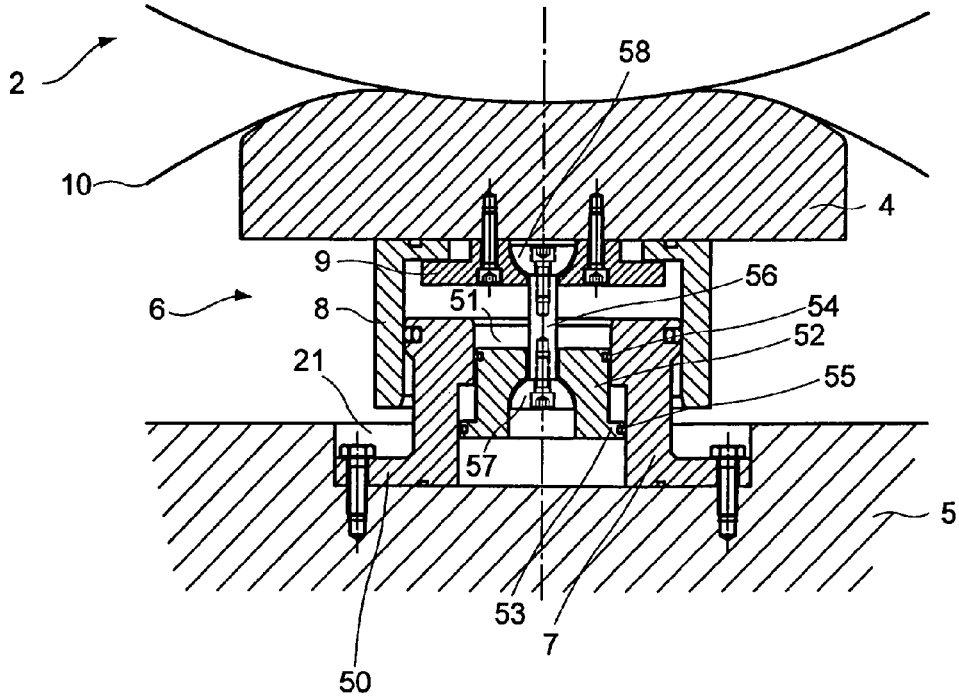
FIG. 7 is a side view in section of the loading device featuring an additional retraction cylinder for the press shoe.

Referring now to FIG. 7 there is illustrated still another alternative embodiment of the present invention wherein the first guide element 7 is configured as a truncated cylinder comprising at the underside in relation to the supporting device 5 a bolting flange 50 by which the truncated cylinder 7 is bolted to the supporting device 5. For this purpose, the supporting device 5 comprises a larger recess 21 within which the truncated cylinder 7 is secured such that adequate freedom of movement of the hydraulic device 6 in the aforementioned sense is assured particularly also when the stroke is small.

The truncated cylinder 7 is accommodated in the cylinder sleeve 8 in the manner as described above, the truncated cylinder 7 in the embodiment as shown in FIG. 7 featuring a further recess 51 comprising particularly in relation to the longitudinal centerline of the truncated cylinder 7 at least two different diameters, the smaller opening being provided preferably at the side facing the press shoe 4. Inserted in this supporting device 5 in the example aspect as shown in this case is a locating flange 53 particularly intended to prevent the locating cylinder 52 from sliding out of place from the recess 51. By means of the seals 54 and 55 the locating cylinder 52 is sealed off from the inner wall of the truncated cylinder. Hydraulic fluid can be directed into the space between the seals and the inner side of the truncated cylinder and the outer side of the locating cylinder 52 in accordance with a preferred embodiment, as a result of which moving and loading the locating cylinder 52 can be guided downwards.

The locating cylinder 52 is connected to the second guide element 9 via a longitudinal connection 56, for this purpose the disk of the second guide element 9 and the locating cylinder 52 featuring corresponding recesses in which corresponding counterparts 57 and 58 are arranged and with which the longitudinal connection 56 is bolted, for example.

By means of this connection 56 and the shiftable locating cylinder 52 it is possible to communicate a tensile force to the underside of the press shoe 4 which is particularly able to lift and lower the press shoe 4 in a predefined portion from the mating roll 2.

It is, of course, also in keeping with the present invention to undertake modifications of the present connection between the press shoe 4 and locating cylinder 52, it being particularly advantageous when the connection 56 does not limit the freedom of movement of the hydraulic device 6 between the various components, corresponding openings or movable connecting members such as, for example, half-shells as counterparts 57 and 58 with corresponding boltings being used in particular.

Figure 8:
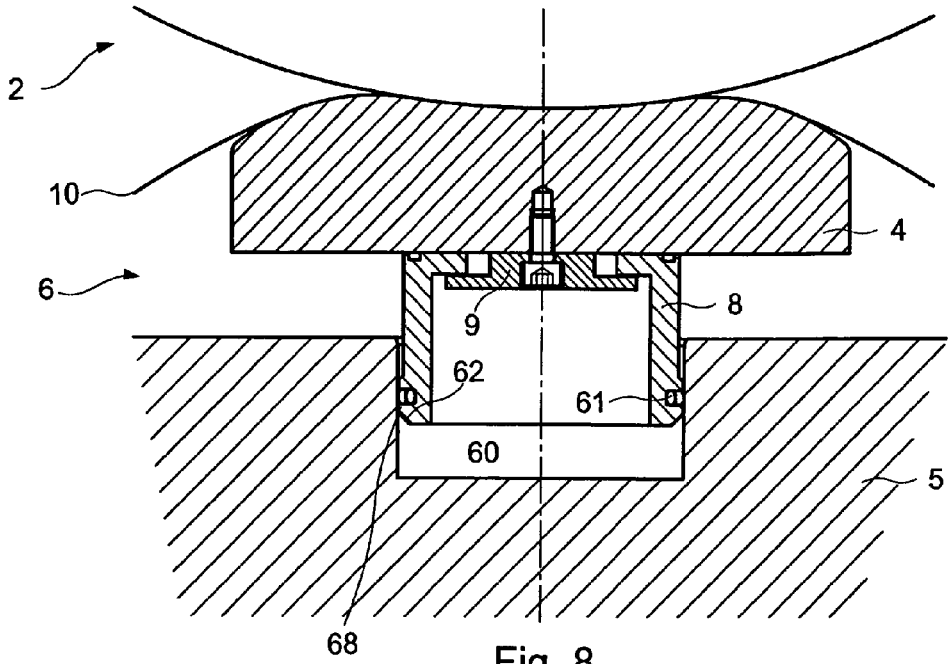
FIG. 8 is a side view in section of an alternative embodiment of the first guiding device.

Referring now to FIG. 8 there is illustrated still another particularly preferred embodiment of the present invention wherein the first guide element is integrated in the supporting device 5. For this purpose the supporting device 5 comprises a recess 60 in which the cylinder sleeve 8 is arranged substantially shiftable lengthwise. To ensure adequate sealing of the hydraulic system, a seal 61 is seated on the outer side of the cylinder sleeve 8 which in accordance with the example aspect as shown in this case is integrated in a circumferential bulge 68. In accordance with this embodiment it is, here too, ensured that the cylinder sleeve 8 can be tilted by a predefined amount. In addition, the cylinder sleeve 8 comprises at the lower outer circumference a chamfer 67 further ensuring that the inner side of the recess 60 is prevented from being marked.

Figure 9:
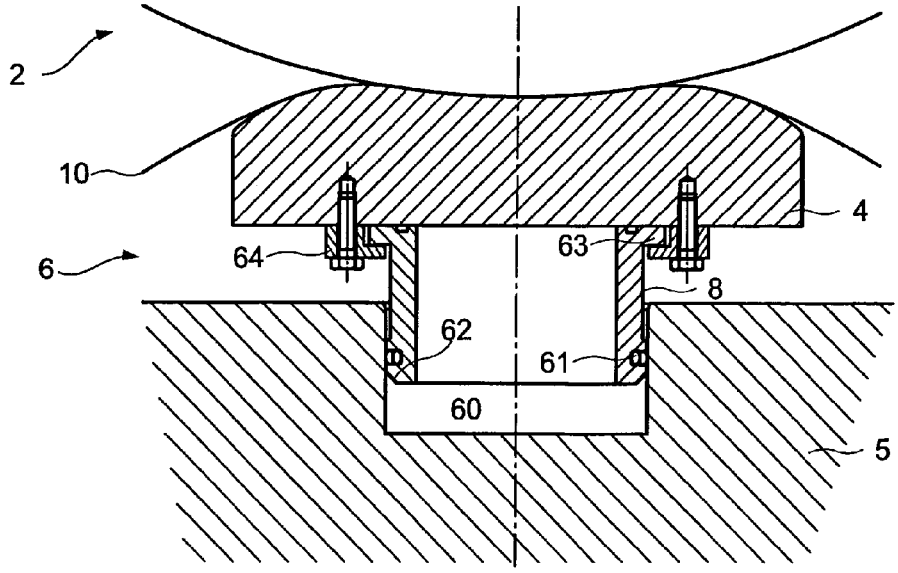
FIG. 9 is a side view in section of the embodiment as shown in FIG. 8 featuring an alternative second guiding device.

In accordance with the embodiment as shown in FIG. 8 the cylinder sleeve 8 is secured to the underside of the press shoe by a disk 9 located on the inside. Referring now to FIG. 9 there is illustrated how in a further example aspect the cylinder sleeve 8 features an outer flange 63 with a seal secured by means of a stepped ring 64 to the underside of the press shoe.

It is to be noted that like components are identified by like reference numerals in each of the Figs.

The invention claimed is:

1. A shoe press comprising:

a shoe press roll and a mating roll for forming a press nip in a papermaking machine, the shoe press roll having at least one press shoe and at least one supporting device;

the press shoe and supporting device being connected by a plurality of hydraulic devices, and wherein each the hydraulic device from the plurality of hydraulic devices comprises:

at least one first guide element, a cylinder sleeve being substantially linearly guided by the at least one first guide element, and a second guide element which is connected to the press shoe substantially fixedly, the second guide element including an engaging portion that engages a portion of the cylinder sleeve, wherein a seal is created between the press shoe and a face of the cylinder sleeve; and, wherein the portion of the cylinder sleeve engaging the engaging portion is guided therein with a predefined clearance such that the seal between the face of the cylinder sleeve and the press shoe is maintained when the press shoe is tilted.

2. The shoe press as set forth in claim 1, further comprising at least one fluid connection is provided between the cylinder sleeve and the second guide element and which interconnects at least a first and second fluid portion of the hydraulic device.

3. The shoe press as set forth in claim 2, wherein the at least one fluid connection is selected from a group of connections comprising slots, grooves, drillings, recesses, and combinations thereof.

4. The shoe press as set forth in claim 3, further comprising the first fluid portion being formed by at least one section of the first guide element, at least one section of the cylinder sleeve, and at least one section of the second guide element.

5. The shoe press as set forth in claim 2, further comprising the second fluid portion being formed by at least one section of the cylinder sleeve, at least one section of the second guide element, and at least one section of the press shoe.

6. The shoe press as set forth in claim 2, further comprising a fluid connection between the first and second fluid portions.

7. The shoe press as set forth in claim 6, wherein the fluid connection comprises at least one groove, ribbing, gritted, a multiplicity of spacers, a predefined roughness of the surfaces, or combinations thereof.

8. The shoe press as set forth in claim 1, further comprising the first guide element being a truncated cylinder corresponding substantially to an inner diameter of the cylinder sleeve.

9. The shoe press as set forth in claim 1, further comprising the first guide element is a recess in the supporting device, within which the cylinder sleeve is arranged.

10. The shoe press as set forth in claim 1, further comprising the second guide element being a disk arranged at the press shoe, comprising or forming at least one radial circumferential groove.

11. The shoe press as set forth in claim 1, wherein the seal forms a sealing surface.

12. The shoe press as set forth in claim 11, further comprising a diameter of the sealing surface being smaller than or substantially equal to a diameter of the cylinder sleeve.

13. The shoe press as set forth in claim 1, wherein the engaging portion comprises a groove.

14. The shoe press as set forth in claim 1, further comprising the first guide element including at least one feeder for a fluid.

15. The shoe press as set forth in claim 1, further comprising the first guide element being connected non-positively, positively or material-positively to the supporting device.

16. The shoe press as set forth in claim 15, further comprising the second guide element being connected non-positively, positively or material-positively to at least one section of the press shoe.

17. The shoe press as set forth in claim 1, further comprising the cylinder sleeve including a freedom of movement being substantially axially parallel to the first guide element and tiltable about a predefined angle ($\alpha$) in relation to a main axis of the first guide element.

18. The shoe press as set forth in claim 1, further comprising at least one seal being disposed between the first guide element and the cylinder sleeve.

19. The shoe press as set forth in claim 1, further comprising the cylinder sleeve being connected to the first and second guide elements.

20. The shoe press as set forth in claim 1, further comprising the cylinder sleeve and the guiding devices being made of at least one material selected from a group including steel, bronze, brass, stainless steel, composites, and combinations thereof.

21. The shoe press as set forth in claim 1, further comprising the first and second guide elements being interconnected by at least one axial longitudinal connection which limits a maximum spacing between the first and second guide elements.

22. The shoe press as set forth in claim 1, wherein the hydraulic device further comprises a retraction cylinder for unloading the press shoe or for separating the press shoe from a mating cylinder.

* * * * *

UNITED STATES PATENT AND TRADEMARK OFFICE

CERTIFICATE OF CORRECTION

PATENT NO. : 8,118,980 B2
APPLICATION NO. : 12/525187
DATED : February 21, 2012
INVENTOR(S) : Wolfgang Mark It is certified that error appears in the above-identified patent and that said Letters Patent is hereby corrected as shown below:

Col. 10, line 4 After the word "shoe" please delete "substantially fixedly".

Signed and Sealed this
First Day of May, 2012

David J. Kappos

David J. Kappos
*Director of the United States Patent and Trademark Office*